US005107962A

United States Patent [19]

Ekholm

[11] Patent Number: 5,107,962

[45] Date of Patent: Apr. 28, 1992

[54] VERTICAL TRANSPORT SYSTEM IN A BUILDING

[75] Inventor: Ralf Ekholm, Helsinki, Finland

[73] Assignee: Kone Elevator GmbH, Baar, Switzerland

[21] Appl. No.: 602,616

[22] Filed: Oct. 24, 1990

[30] Foreign Application Priority Data

Sep. 11, 1989 [FI] Finland ..... 895347

[51] Int. Cl.[5] ..... B66B 9/00

[52] U.S. Cl. ..... 187/16; 187/1 R

[58] Field of Search ..... 187/1 R, 16, 101, 15

[56] References Cited

U.S. PATENT DOCUMENTS 3,750,849 8/1973 Berkovitz ..... 187/16
4,723,627 2/1988 Ito ..... 187/16
4,838,385 6/1989 Ekholm ..... 187/101

FOREIGN PATENT DOCUMENTS 1084001 6/1960 Fed. Rep. of Germany .
863861 9/1989 Finland .
1547817 11/1968 France .

*Primary Examiner*—Joseph E. Valenza
*Assistant Examiner*—Kenneth Noland

[57] ABSTRACT

Vertical transport system in a building provided with one or more hoistways with elevator cars moving in them, comprises at least one hoistway accommodating at least two elevator cars travelling above one another in such a manner that one (2) of the cars travels in the hoistway (1) between the entrance floor and a certain higher floor or certain higher floors, i.e. change levels (11,13*a*,13*b*,18). One or more other cars (4,5) travel in the part of the same hoistway (1) which lies above the change levels (11,13*a*,13*b*,18), in the spaces between or divided by the hoisting ropes (3) of the elevator operating in the lower part of the hoistway.

19 Claims, 4 Drawing Sheets

VERTICAL TRANSPORT SYSTEM IN A BUILDING

BACKGROUND OF THE INVENTION

The present invention relates to a vertical transport system in a building having one or more hoistways and elevator cars travelling in them.

DESCRIPTION OF THE BACKGROUND ART

Previously known vertical transport systems in buildings are generally based on elevators whose cars travel essentially through the whole length of the vertical shafts provided for them. However, in sky scrapers, where the space required by the transport system is a cost factor which is the more critical the higher the building is, the space required by elevator system has not been effectively minimized. On the contrary, in very tall buildings, in order to maintain a high service standard of the transport systems, it has been necessary to resort to various arrangements for the division of work between elevator groups e.g. by providing the building with one or more so-called sky lobbies or change levels which serve as terminal floors for certain elevator groups and as starting floors for other groups, and where the passengers change elevators if they desire to travel further in either direction. These arrangements, including the machine rooms of the elevators operating below the sky lobby and the waiting rooms and escalators that may be needed for flexible transit traffic, occupy at least on certain floors even more space than before and cause delays in the traffic.

SUMMARY OF THE INVENTION

The object of the present invention is to achieve a new type of vertical transport system in which the spaces required by the hoistways in tall buildings are minimized and which maximizes the speed and flexibility of the transit traffic in the sky lobbies.

To achieve this object, the transport system of the invention is characterized in that it comprises at least one hoistway accommodating at least two elevator cars travelling above one another in such, a manner that one car travels in the hoistway between the entrance floor and a certain higher floor or certain higher floors, i.e. change levels, and that one or more other cars travel in the part of the same hoistway which lies above said change levels, in the spaces between or divided by the hoisting ropes of the elevator operating in the lower part of the hoistway.

The invention provides a variety of advantages, the most obvious of which are the reductions in the space requirements of the system. The change levels or sky lobbies can be made simpler and smaller because there will be less need for passengers to change between elevators travelling in different hoistways. The top and bottom spaces of the hoistways and their machine rooms, which in previously known systems had to be provided separately for each hoistway, are now combined. The invention reduces the need for stairs or similar arrangements, used especially at the terminals of elevator systems with double-decker cars to allow passenger traffic between hoistways. Also, since the hoistways of the elevators operating above those coming from below need not be built separately starting from the side of the hoistways of the latter, the space formed by the hoistways together in the building will become straighter and more symmetrical. The combined elevator hoistways thus form a supporting structure that extends from bottom to top of the sky-scraper and has a stronger structural design. Especially in buildings having a relatively narrow cross-sectional form, this advantage is more significant.

Another advantage, resulting from the simplification of the sky lobbies, is a reduction in the passengers' total travelling time, because, when changing elevators, they need not walk long distances from one elevator to another to get to their destination.

Moreover, the system provides flexibility in the placement of the sky lobby. If required, minor changes of the placement of the lobby are relatively easy to carry out as it is no longer necessary to have any fixed building structures in conjunction with the lobby.

The other preferred embodiments of the invention are characterized by what is presented in the claims to follow.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described below in detail by the aid of examples, reference being made to the drawings attached which are given by way of illustration only, and thus are not limitative of the present invention, and wherein.

DETAILED DESCRIPTION OF THE PREFERRED EMBODIMENTS

Figure 1:
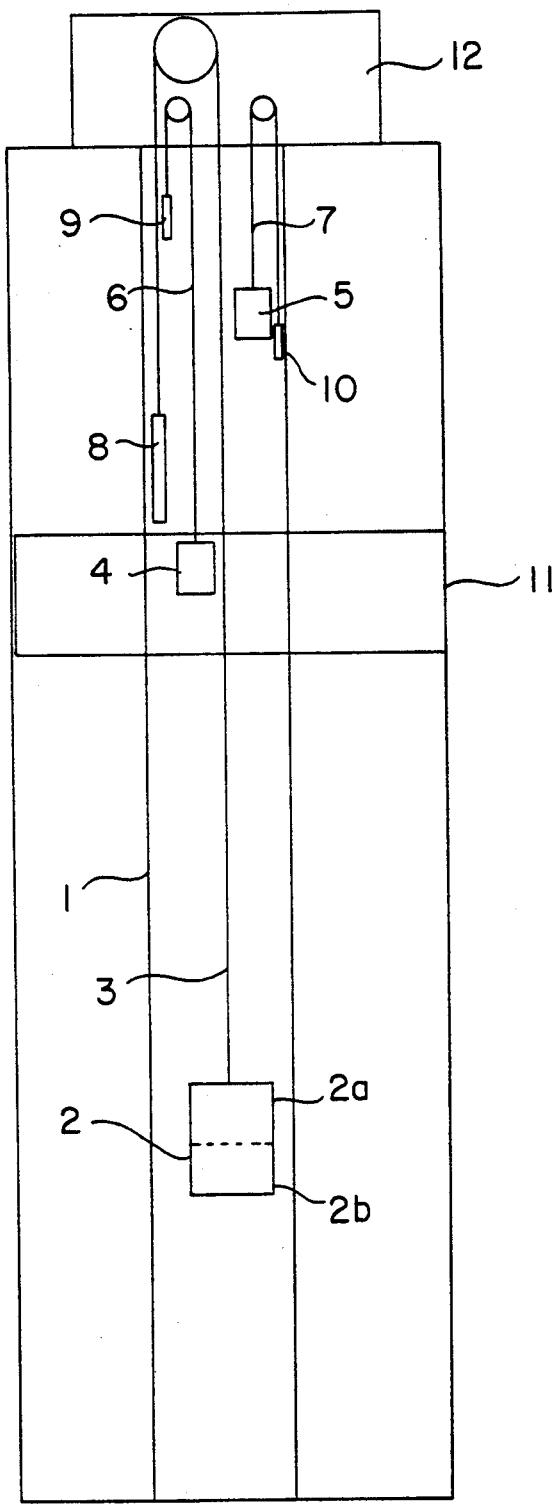
FIG. 1 presents an embodiment of the transport system of the present invention.

FIG. 1 illustrates the transport system of the invention in a building where the main elevator operating between the entrance floor and the sky lobby uses a car with two decks 2*a* and 2*b*, i.e. a car of the "double-decker" type. As this type of car doubles the number of passengers that can be transported at a time, it is often used in tall buildings with the main elevators operating between two terminals only, the number of these elevators being usually 6–8. For the sake of clarity, the figure only shows one hoistway and the elevator cars operating in it. In reality there is more than one hoistway. Operating above the change level 11 or sky lobby there are two delivery elevators 4 and 5, which are substantially smaller than the main elevator. The cars of the delivery elevators travel on different sides of the hoisting ropes of the main elevator. The cars of both the main elevator and the delivery elevators travel in the same hoistway, operating in different parts of the hoistway except for the change levels. The hoisting ropes 3 and 6, 7 of all three elevators run through a common machine room 12 located above the delivery elevators.

The counterweights 9, 10 of the delivery elevators 4, 5 and the counterweight 8 of the main elevator travel on their guide rails in a space reserved for them.

To prevent collisions between the main elevator and the delivery elevators, the system always maintains a sufficient safety distance between the cars, which cannot be cancelled by the control algorithm of the elevator groups. In the determination of the safety distance, the length of the car cable (not shown) hanging below the delivery elevators is taken into account.

Figure 2:
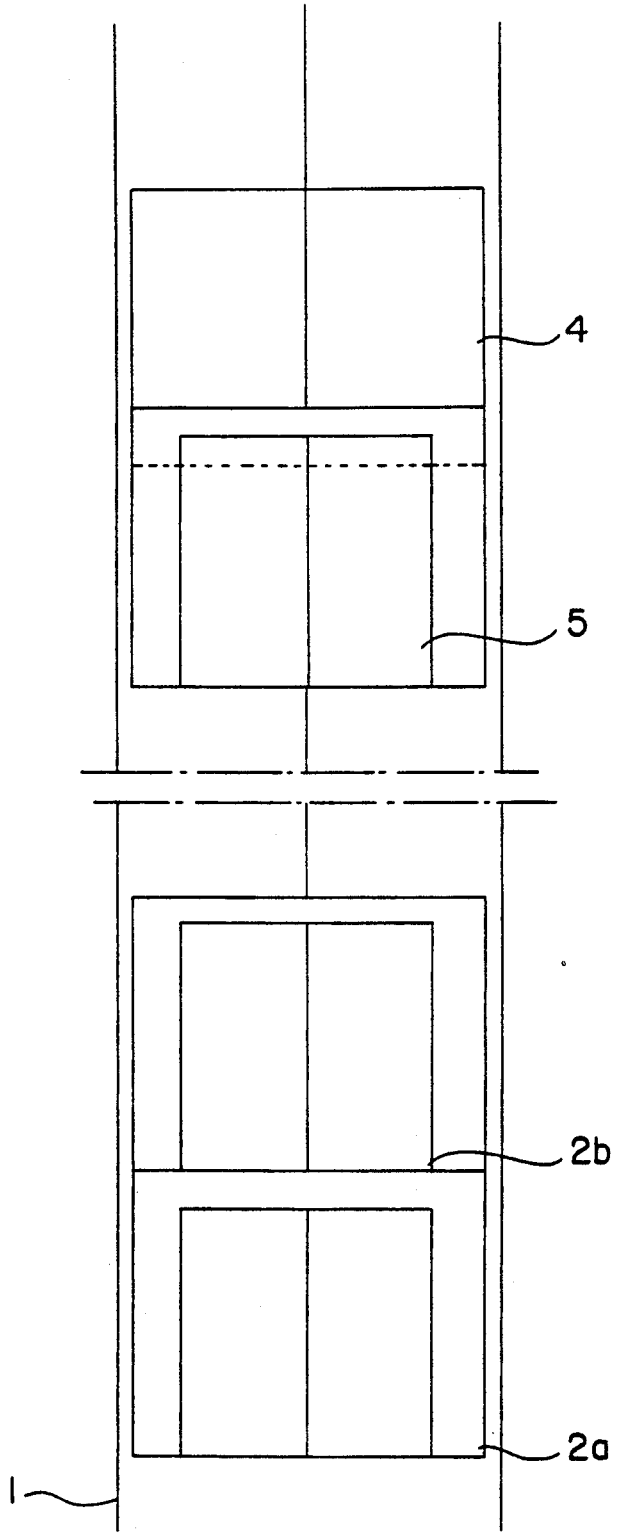
FIG. 2 presents a simplified view of the system in FIG. 1 as seen from the right.

FIG. 2 presents a simplified view of the system of FIG. 1 as seen from the right. In this example, the compartments 2*a*, 2*b* of the main elevator car 2 are of the walk-through type, i.e. they have doors at both ends. The doors are so designed that the main elevator can use the same landing doors as the delivery elevators 4, 5. The orientation of the elevator cars relative to each other is shown in FIG. 2. Seen from the opposite side of the cars, the situation is fully analogous.

Figure 3:
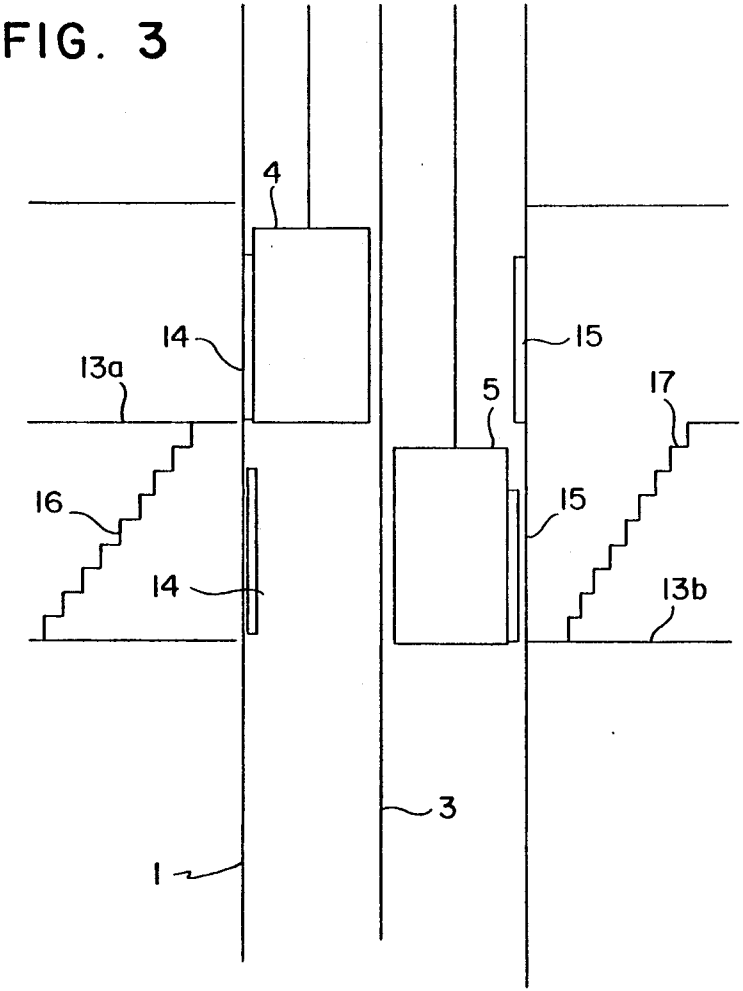
FIG. 3 presents an example of the change level used in the transport system illustrated by FIG. 1.

FIG. 3 illustrates a situation where the delivery elevators have arrived at the sky lobby. Since the main elevator has a double-decker car as shown in FIGS. 1 and 2, the sky lobby also comprises two floors on which the passengers may disembark from the main elevator The main elevator preferably has a walk-through car as mentioned above, in which case the delivery elevators will stop either at change level 13*a* or 13*b* depending on the calls, so that the stairs 16 and 17 shown in the figure are unnecessary. However, if this is not the case, i.e. if landing doors 14 and 15 are only provided on one side of the hoistway, a flexible change of elevators can be arranged e.g. by using stairs 16 and 17 together with indicators announcing the arrival of a delivery elevator. The change level may also consist of one floor only, in which case one of the compartments of a double-decker main car is first brought to the change level, whereupon, after the passengers have embarked and disembarked, the other compartment of the car is brought to the change level. However, in the case of double-decker elevators, a one-floor sky lobby is not as effective as a two-floor one with regard to passenger flow.

Figure 4:
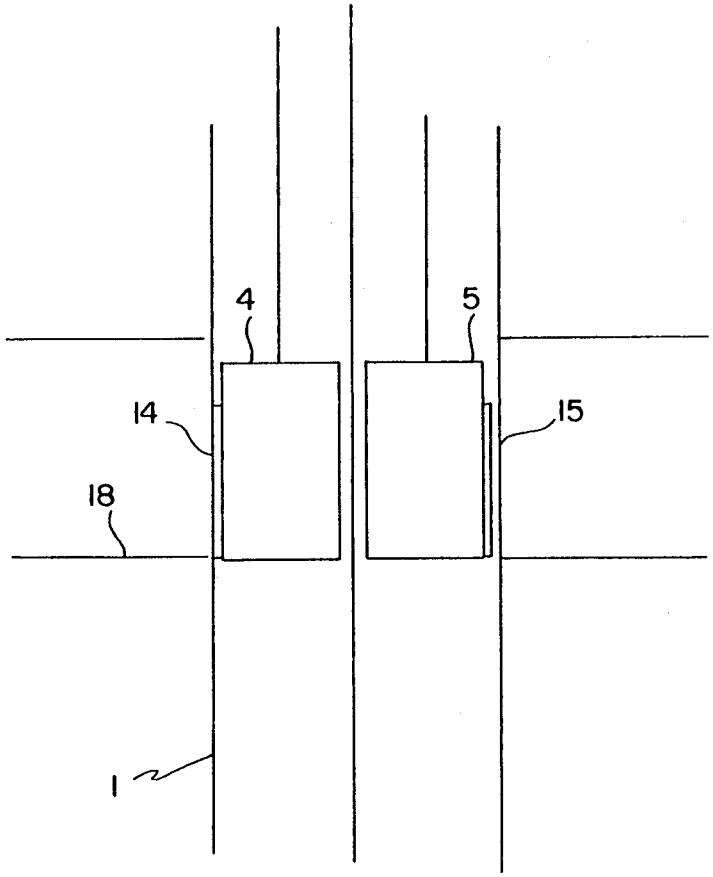
FIG. 4 presents an example of the change level used in another embodiment.

FIG. 4 illustrates a situation corresponding to FIG. 3 in a case where the main elevator has a single-deck walk-through car. Landing doors 14, 15 are provided on both sides of the hoistway and the delivery elevators 4,5 may be simultaneously at the sky lobby. This makes it easier to design the sky lobby and allows easy changes of its placement.

Figure 5:
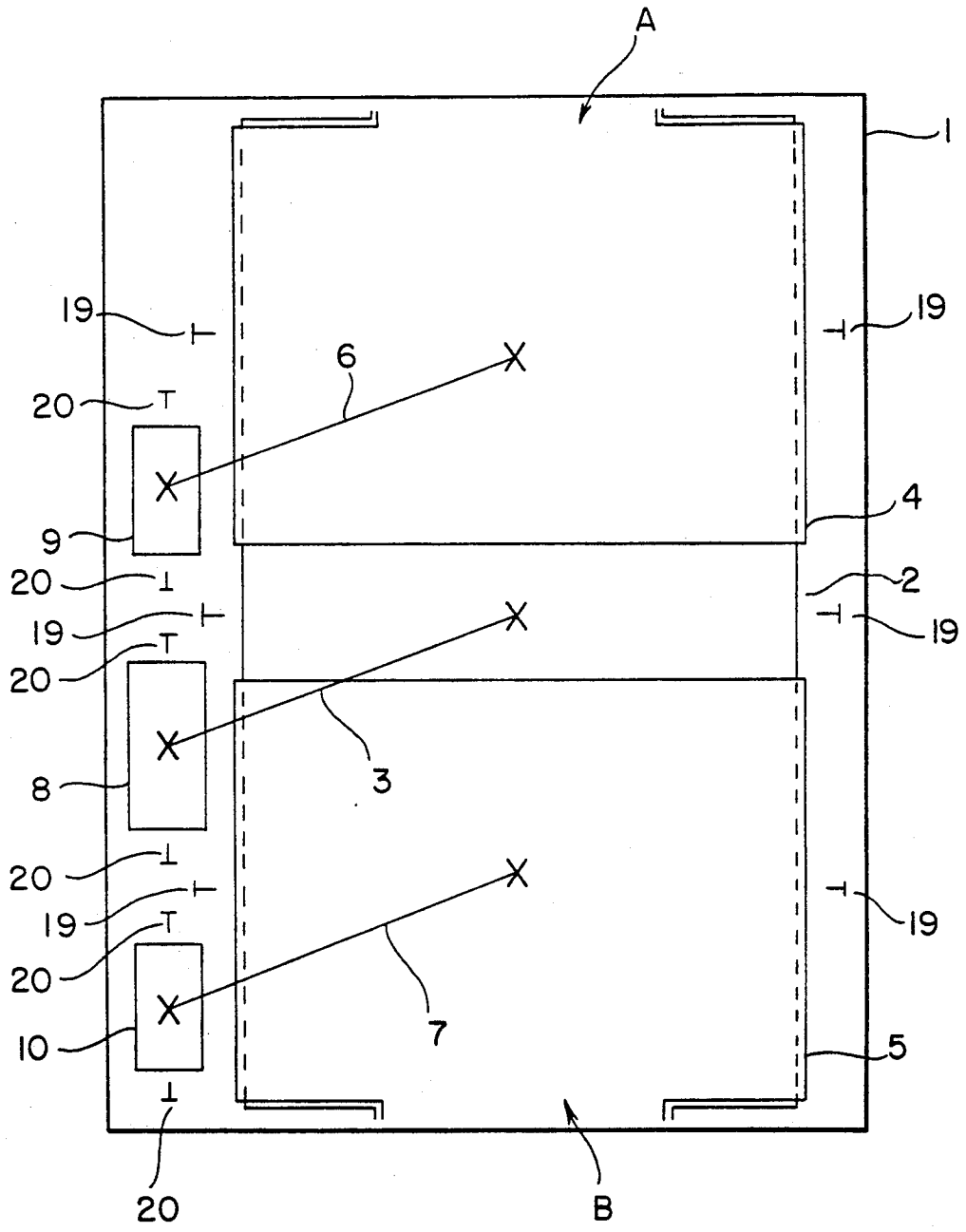
FIG. 5 presents an example of the placement of the elevators in the hoistway in the transport system of the invention, seen from above.

FIG. 5 shows a possible placement of the elevators in the hoistway 1 of the transport system of the invention as seen from above. The walk-through car 2 of the main elevator has two doorways A and B allowing passage to the landings. Each of the delivery elevators 4 and 5 has a car with one doorway. The doorway of elevator 4 faces the same side of the hoistway as doorway A of the main elevator while the doorway of elevator 5 faces the same side as main elevator doorway B. Thus, the same landing doors can be used at the sky lobby. The counterweights 8, 9 and 10 of the three elevators travel on their respective guide rails on one side of the hoistway. Since each elevator in the transport system only travels through part of the length of the hoistway, sufficient vertical space is left in the hoistway in addition to the range of motion of the counterweights to allow the height of the latter to be increased so as to make them sufficiently heavy. In this way, the counterweights are made narrow enough to permit them to be placed in the space between the holders of the guide rails of the three elevators. The figure does not show the holders to which the car and counterweight guide rails 19, 20 are attached. For the sake of clarity, the figure only shows a single hoisting rope 3, 6, 7 for each elevator. The machine room equipment, including the traction sheaves and diverting pulleys carrying the weight of the cars 3, 6, 7 and counterweights 8, 9, 10, are not shown.

The transport system of the invention can largely be controlled using existing modern control algorithms for elevator groups, e.g. the so-called meta control algorithm described in the applicant's Finnish patent application no. 863861, in which the control of the feeding elevator and the group control of the delivery elevators are coordinated.

The changes in the control and construction of an elevator system required for the implementation of the invention involve the supervision arrangements relating to the safety distance between elevator cars and program changes allowing the recognition of collision situations well in advance to prevent actual collisions. The end-of-hoistway supervision solutions employed in conventional elevators can be so applied that they will render collisions totally impossible. The buffers of the delivery elevators are placed at the change level. They can be mounted e.g. in the side walls of the hoistway in alignment with corresponding projections mounted on the elevator cars.

It is obvious to a person skilled in the art that different embodiments of the invention are not restricted to the examples described above, but that they may instead be varied within the scope of the following claims. For example, the lowest entrance into the transport system can be placed on a floor other than the bottom floor of the building and the transport of passengers to this floor arranged e.g. using escalators. Similarly, the main entrance into the building can be placed on a floor other than the bottom floor, in which case the main entrance into the transport system is usually placed on the same floor.

Also, the counterweights may be so placed in the hoistway that one or some of them travel directly above other counterweight(s). This is feasible especially in cases where the total length of the ranges of motion of the two delivery elevators is clearly less than the length of the hoistway. Another and quite usable possibility of achieving this is e.g. the use of diverting pulleys to change the suspension ratio so as to halve the range of motion of the counterweights, although in this case the weight of the counterweights must be increased correspondingly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A vertical transport system in a building having an entrance floor, at least one change level and floors above said t least one change level, said at least one change level being located above the entrance floor, said building further having a hoistway, the vertical transport system comprising:

a set of elevator cars provided in the hoistway, each set comprising at least two elevator cars travelling above one another in such a manner that one car travels between the entrance floor up and into the at least one change level and another car travels between the at least one change level and the floors above said at least one change level;

hoisting ropes for each set of elevator cars, each car having at least one hoisting rope in the hoistway attached thereto and at least one of the cars of the set travelling in spaces divided by or between the hoisting ropes in the hoistway above that at least one change level; and control means for moving each of the elevator cars of the st independently of other elevator cars in the set, each car in the set being simultaneously movable in a coordinated manner.

2. The vertical transport system as recited in claim 1, further comprising landing doors on the at least one change level, said landing doors permitting entrance to both of the at least two elevator cars in the set of elevator cars.

3. The vertical transport system as recited in claim 1, wherein a total of three elevator cars are provided, two of the elevator cars being upper elevator cars provided to travel between the at least one change level and the floors above said at least one change level, the hoisting rope for a lower elevator of the three total elevator cars travelling between the entrance floor and the at least one change level passing through a space between the upper elevator cars.

4. The vertical transport system as recited in claim 4, wherein a total of three elevator cars are provided, two of the elevator cars being upper elevator cars provided to travel between the at least one change level and the floors above said at least one change level, the hoisting rope for a lower elevator of the three total elevator cars travelling between the entrance floor and the at least one change level passing through a space between the upper elevator cars.

5. The vertical transport system as recited in claim 1, wherein one lower elevator car is provided to travel between the entrance floor and the at least one change level, the one lower elevator car being a walk-through double-decker car and wherein two said floors are provided for the at least one change level, each of the two floors having landing doors for the lower elevator car and the other elevator cars of the set also using both the landing doors of the two floors.

6. The vertical transport system as recited in claim 2, wherein one lower elevator car is provided to travel between the entrance floor and the at least one change level, the one lower elevator car being a walk-through double-decker car and wherein two said floors are provided for the at least one change level, each of the two floors having landing doors for the lower elevator car and the other elevator cars of the set also using both the landing doors of the two floors.

7. The vertical transport system as recited in claim 3, wherein one lower elevator ar is provided to travel between the entrance floor and the at least one change level, the one lower elevator car being a walk-through double-decker car and wherein two said floors are provided for the at least one change level, each of the two floors having landing doors for the lower elevator car and the other elevator cars of the set also using both the landing doors of the two floors.

8. The vertical transport system as recited in claim 1, wherein the hoistway is a generally straight, vertical shaft forming a supporting structure for the building.

9. The vertical support system as recited in claim 8, wherein a common machine room is provided adjacent the hoistway, the common machine room housing operating machinery for all of the elevator cars in the set of elevator cars operating in the hoistway.

10. The vertical transport system as recited in claim 1, wherein the control means prevents elevator cars operating in the hoistway from colliding.

11. The vertical transport system as recited in claim 1, wherein the control means allows the at least one change level to be changed from at least one floor to another at least one floor in the building.

12. The vertical transport system as recited in claim 1, wherein the at least one change level is two floors of the building, the at least one elevator car travelling between the entrance floor and the at least one change level travels through a plurality of floors between the entrance floor and the at least one change level through a plurality of floors above the change level, all elevator cars of the set further travelling to both floors of the change level.

13. A method of vertical transport in a building having an entrance floor, at least one change level and floors above the change level, said at least one change level being located above the entrance floor, said building having a hoistway, the method comprising the steps of:

providing a set of elevator cars in the hoistway, the set comprising at least one delivery elevator car and a main elevator car, the at least one delivery elevator car travelling above the main car;

moving the main car between the entrance floor up and into the at least one change level;

selectively, simultaneously moving the at least one delivery car between the at least one change level and the floors above the at least one change level while the main car is moving between the entrance floor and the at least one change level; and controlling movement of the at least one delivery car and the main car for independent and simultaneous movement thereof.

14. The method as recited in claim 13, further comprising the steps of:

providing hoisting ropes attached to the delivery elevator car and the main car; and defining a space in the hoistway be the hoisting rope for the main car, the at least one delivery car travelling in the space defined by the hoisting rope of the main car.

15. The method as recited in claim 14, wherein two delivery elevator cars are provided in the set of elevator cars, each delivery elevator car having a hoisting rope and further comprising the step of passing each delivery elevator car on one side of the hoisting rope of the main car in the defined space s the delivery elevator cars move between the at least one change level and the floors above the at least one change level.

16. The method as recited in claim 13, further comprising the steps of providing a walk-through double-decker elevator ar as the main car, the at least one change level being two adjacent floors of the building which are serviced by the main car.

17. The method as recited in claim 13, wherein the step of controlling further comprises the steps of preventing elevator cars operating in the hoistway from colliding and permitting the at least one change level to be changed from at least one floor to another at least one floor in the building.

18. The method as recited in claim 13, wherein the step of moving the main car includes moving the main car through a plurality of floors between the entrance floor and into the at least one change level.

19. The method as recited in claim 13, wherein the at least one change level is two floors of the building and wherein two delivery elevator cars are provided above the main elevator car, the step of moving the delivery cars comprises independently moving each of the delivery cars into the change level to ether of the two floors of the change level.

* * * * *